US006705497B1

(12) United States Patent
Schuett

(10) Patent No.: US 6,705,497 B1
(45) Date of Patent: Mar. 16, 2004

(54) HOLDER/DISPENSER FOR GOLF BALL MARKERS

(76) Inventor: Scott S. Schuett, 800 Elaine Dr., Beloit, WI (US) 53511

( * ) Notice: Subject to any disclaimer, the term of this patent is extended or adjusted under 35 U.S.C. 154(b) by 64 days.

(21) Appl. No.: 10/160,642

(22) Filed: Jun. 3, 2002

(51) Int. Cl.[7] ..... A45F 5/00

(52) U.S. Cl. ..... 224/247; 224/269; 224/918

(58) Field of Search ..... 224/918, 269, 224/666, 247, 191; 206/223, 315.1, 486, 579; D3/215, 221, 224

(56) References Cited

U.S. PATENT DOCUMENTS

D165,253 S * 11/1951 Ward ..... D3/224
3,753,519 A * 8/1973 Gammon ..... 206/223
D252,422 S * 7/1979 Gillenwater ..... D3/221
D257,189 S * 10/1980 Winbauer ..... D3/221
D257,796 S * 1/1981 Winbauer ..... D3/221
4,475,676 A * 10/1984 Smith ..... 224/247
D296,156 S * 6/1988 Deany et al. ..... D3/221
D301,286 S * 5/1989 Hird ..... D3/221
D443,329 S * 6/2001 Helmreich ..... D21/796
D467,068 S * 12/2002 Lewis et al. ..... D3/215

* cited by examiner

*Primary Examiner*—Stephen K. Cronin
(74) *Attorney, Agent, or Firm*—Craig A. Fieschko, Esq.; DeWitt Ross & Stevens S.C.

(57) ABSTRACT

A holder and dispenser for golf ball markers includes a body which may be clipped onto a user's belt, waistband, golf bag, or other article. The body has one or more pockets defined therein, with the pockets being configured to snugly and removably receive disc-shaped (or other) golf ball markers. The user may withdraw golf ball markers from the holder for use when needed, and may replace them when the markers are no longer used.

19 Claims, 2 Drawing Sheets

HOLDER/DISPENSER FOR GOLF BALL MARKERS

FIELD OF THE INVENTION

This disclosure concerns an invention relating generally to sports equipment, and more specifically to golfing equipment and golfing aids.

BACKGROUND OF THE INVENTION

Golf ball markers are commonly used during a game of golf to mark the original location of a golf ball when the ball needs to be moved (for example, when a ball comes to rest against an obstruction which needs to be removed before play can resume, when the ball needs to be moved for cleaning, or to make way for another ball). As of 2002, the United States Golf Association (USGA) Rule 20-1 states that a golf ball to be moved should be marked by placing a "small coin or other similar object" immediately behind the ball prior to moving it, and when the ball is to be replaced, it should be situated in the same position from where it was lifted.

The "small coin or other object" rule is somewhat vague as to the allowable scope of objects that may be used as markers, and many golfers have found danger in straying too far from the explicit letter of the rule. For example, during tournaments or other events, some golfers who did not have coins or similar disc-shaped markers on hand have attempted to use hotel room keys or other objects as markers—only to be penalized one stroke by the judges for violation of a strict interpretation of the rule (or stricter tour or local rules). Thus, to serious golfers, the rule is not trivial.

As one might imagine, problems occasionally arise because golfers do not have suitable markers on hand during the game (i.e., the golfer is carrying no coins and has no other appropriate marker). As a consequence, other provisions of Rule 20-1 allow the ball position to be marked with the toe of a putter (which can be cumbersome because the player's ability to handle the ball is limited if the player must simultaneously hold the putter in place), or by scratching the playing surface (which is disfavored owing to the difficulty in seeing a scratch and/or the possibility of damaging the playing surface), or using a leaf or other readily available item (which is disfavored owing to the possibility of the marker blowing away or otherwise being displaced).

Thus, a game of golf may literally be lost for lack of a nickel or other suitable marker. It would therefore be useful to have a means for reminding golfers of the need for a marker during play, and to maintain one or more markers on hand for convenient use.

Figure 1:
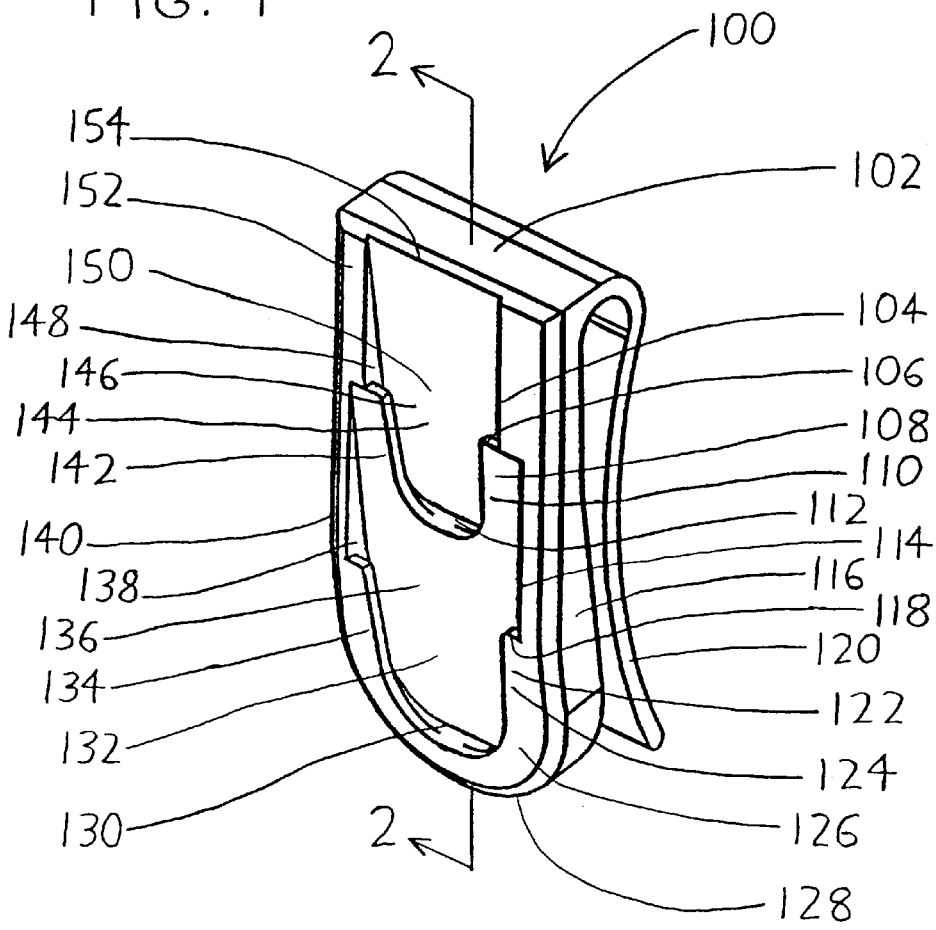
FIG. 1 is a perspective view of a first preferred version of the invention.

For the convenience of the reader, it is noted that the various elements of the marker holders depicted in the Drawings (these elements being discussed below) are labeled with sequentially ascending numbers going clockwise about FIG. 1; counterclockwise about FIG. 2; and clockwise about FIG. 3.

DETAILED DESCRIPTION OF PREFERRED EMBODIMENTS OF THE INVENTION

The invention involves a holder for golf ball markers which is intended to at least partially solve the aforementioned problems. To give the reader a basic understanding of some of the advantageous features of the invention, following is a description of exemplary preferred versions of the marker holder. The claims set forth at the end of this document then define the various versions of the invention in which exclusive rights are secured.

Figure 2:
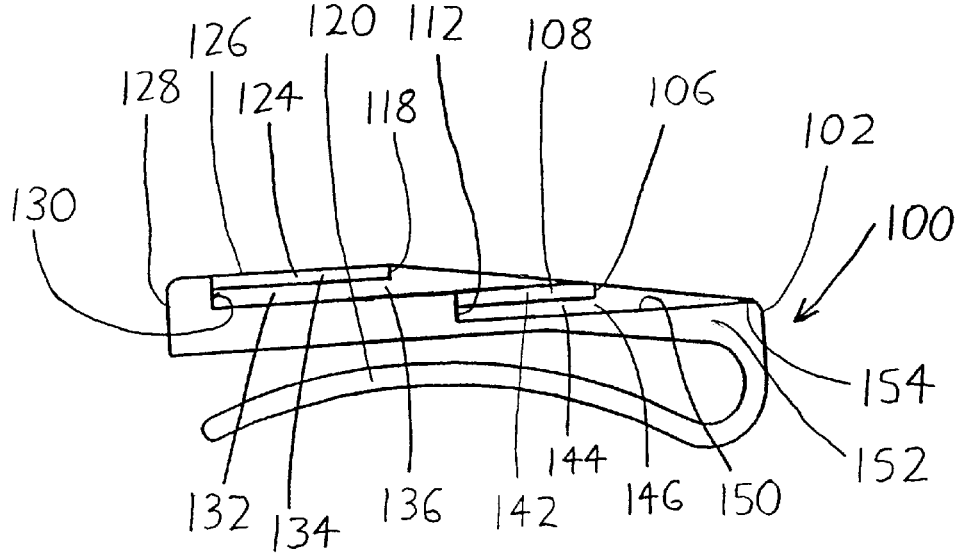
FIG. 2 is a sectional view of the marker holder of FIG. 1, as viewed along the line 2—2 of FIG. 1.
Figure 3:
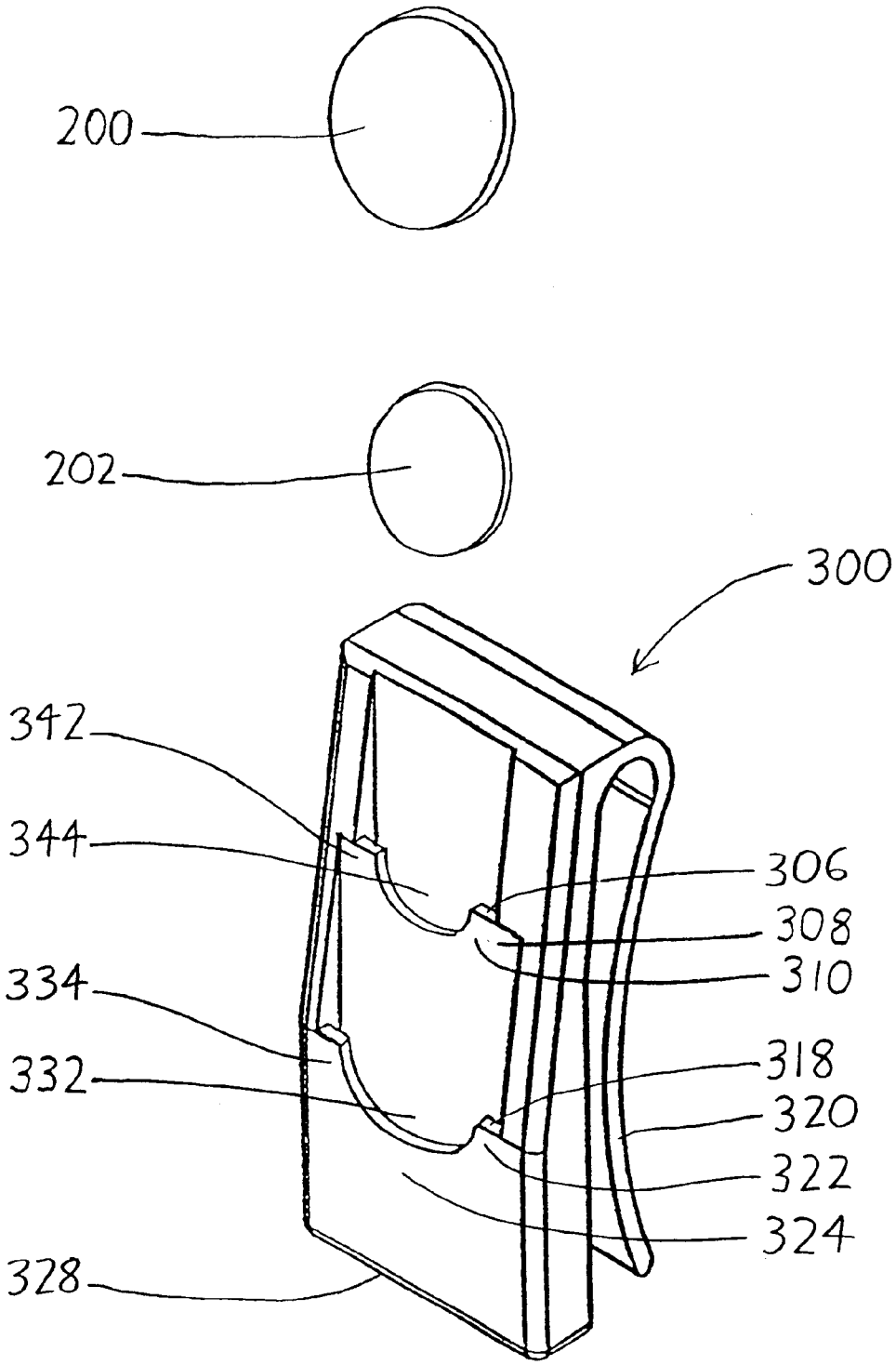
FIG. 3 is a perspective view of a second preferred version of the invention.

Exemplary versions of the invention are depicted by the marker holder 100 in FIGS. 1 and 2, and the marker holder 300 depicted in FIG. 3 (wherein exemplary disc-shaped markers 200 and 202 are also shown). Prior to discussing the details of the structure of the exemplary marker holders 100 and 300, it will initially be useful to discuss their general structure and intended usage. The exemplary marker holder 100 can be characterized as having two portions, a body 152 and a clipping means for mounting the body 152 on a user (the clipping means here being provided in the form of a clip 120). The body 152 has first and second pockets 144 and 132 which are intended to hold ball markers for later removal and use (e.g., for placement on the playing surface of the golf course to mark the position of a golf ball when moving the golf ball for cleaning or to make way for the travel of another ball). The markers may then be replaced within the body 152 of the marker holder 100 after use, if so desired. The clip 120 is intended to allow the body 152 to be mounted to the waist hem of a user's pants, or to the pants pocket or another portion of a user's clothing, so that the markers are readily accessible to the user when needed. Additionally, the marker holder 100 may be clipped to the top of a user's golf bag, or otherwise maintained in a readily visible location with the user's golf equipment, to serve as a reminder to bring a supply of ball markers prior to starting a game.

To further illustrate, turning to the exemplary marker holder 300 of FIG. 3, the exemplary disc-shaped markers 202 and 204—which are here differently sized—are shown along their paths of insertion and removal from the pockets 344 and 332 of the body 152. The markers 202 and 204, which may simply take the form of coins (which are readily available and relatively inexpensive markers), or bingo/poker chips or other preferably brightly-colored items, may be inserted into the pockets 344 and 332 to be snugly received therein, and may be removed for use by sliding them out of the pockets 344 and 332. The marker holders 100 and 300 thereby allow a user to maintain markers readily at hand for use at all times.

Turning to FIGS. 1 and 2, the details of the structure of the exemplary marker holder 100 will now be discussed. The body 152 has a top 102 from which the clip 120 extends, an opposing bottom 128, a pair of opposing sides 116 and 140, a front 126 wherein the first and second pockets 144 and 132 are defined, and an opposing rear (not visible in FIG. 1). The first pocket 144 is defined between opposing sidewalls 104 and 148 on the body 152; an inner wall 150 on the body 152, the inner wall 150 extending between the sidewalls 104 and 148 and having an upper edge 154; an opposing outer wall 108 on the body 152, the outer wall 108 also extending between the sidewalls 104 and 148 and having an upper edge 106; and a pocket floor 112 on the body 152 below the sidewalls 104 and 148, inner wall 150, and outer wall 108. The pocket mouth 146 wherein the marker disc is received is then situated opposite the pocket floor 112, and between the sidewalls 104 and 148 and the upper edges 154 and 106 of the inner and outer walls 150 and 108. The upper edge 106 of the outer wall 108 is preferably situated below the upper edge 154 of the inner wall 150, and is also preferably at least partially depressed or indented to descend downwardly at its midsection, so as to partially expose any marker resting within the first pocket 144 and better allow the marker to be grasped/contacted by a user to effect its removal from the pocket 144. Here, the outer wall upper edge 106 is shown as being indented/depressed (at its lowest point) to the same height as the floor 112. As a result, the outer wall 106 is effectively defined by opposing flanges 110 and 142 which extend inwardly towards each other from the sidewalls 104 and 148. Thus, a marker disc may be inserted into the pocket mouth 146 until it abuts the floor 112, with a major portion of the marker disc being exposed between the flanges 110 and 142 (and being retained within the first pocket 144 by the flanges 110 and 142) so that it may be easily and readily lifted from the first pocket 144 when desired.

Similarly, the second pocket 132 is bounded by opposing sidewalls 114 and 138, an inner wall 108 (which is also the outer wall of the first pocket 144), an opposing outer wall 124, and a pocket floor 130, with the pocket mouth 136 of the second pocket 132 being situated opposite the pocket floor 130 and between the upper edge 106 of the inner wall 108 and the upper edge 118 of the outer wall 124. The second pocket 132 therefore rests adjacent to the first pocket 144 in overlapping relationship, with the pocket mouth 136 of the second pocket 132 spaced below the pocket mouth 146 of the first pocket 144. The upper edge 118 of the outer wall 124 is again preferably situated beneath the upper edge 106 of the inner wall 108, and is preferably downwardly descending at its midsection, thereby defining a pair of opposing and inwardly-extending flanges 122 and 134 in the outer wall 124. The flanges 122 and 134 allow a marker disc inserted within the second pocket 132 to be urged from the second pocket 132 by pushing it from a location between the flanges 122 and 134. Owing to the staggered heights of the first and second pockets 144 and 132, the second pocket 132 (or any marker disc therein) does not obstruct access to the first pocket 144 (or any marker disc therein).

The clip 120 then extends downwardly from, and generally parallel and adjacent to, the body 152 (more specifically, from the top of the body 152 near the upper edge of the inner wall of the first pocket 144). The clip 120 is resiliently flexible so that it may bend slightly outwardly to allow insertion of a user's article of clothing between the clip 120 and the body 152, to mount the body 152 of the holder 100 on a user.

The first and second pockets 144 and 132 are each configured to snugly and removably receive a marker disc therein (with the pockets 132 and 144 preferably being differently sized so that they may receive differently sized marker discs therein). This is better illustrated in FIG. 3, wherein the exemplary marker holder 300 is shown with marker discs 200 and 202 removed (with marker disc 202 being snugly receivable in the first pocket 344 and the marker disc 200 being snugly receivable in the second pocket 332). The ability of the marker holders 100 and 300 to accommodate differently-sized markers 200 and 202 is preferred because a marker is preferably relatively small (so as to minimally obstruct the path of other golf balls on the field of play), but depending on the condition of the field (e.g., long or short grass), a larger marker may be needed for purposes of good visibility and resistance to accidental displacement. Consider, for example, the situation where the marker 200 is sized and configured similarly to a US25¢ coin and the marker 202 is sized and configured similarly to a US5¢ coin. The marker holder 300 is configured generally similarly to the marker holder 100, but the upper edges 306 and 318 of the outer walls 308 and 324 of the pockets 344 and 332 are only slightly downwardly depressed (unlike the marker holder 100, wherein the upper edges 106 and 118 of the outer walls 108 and 124 of the pockets 144 and 132 are depressed all the way to the pocket floors 112 and 130). Thus, the outer walls 308 and 324 of the pockets 344 and 332 are only partially defined by inwardly-extending flanges 310 and 342, and 322 and 334. Additionally, the pocket floors (not visible in FIG. 3) and the body bottom 328 are not curved as with the pocket floors 112 and 130 and the body bottom 128 of the marker holder 100.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, a marker holder may have less or more than two pockets depending on how many markers the marker holder is intended to hold. Ideally, a marker holder will have a pocket for a marker for each player. It is also possible to configure each pocket so that it can snugly and removably receive more than one marker at a time, thereby allowing multiple markers to be received in a single pocket.

Second, the markers need not have a disc-shaped form (though this is recommended for best conformity with the rules of marking), nor need the pockets be configured to only receive markers having a disc shape. A wide variety of other marker and pocket shapes is possible.

Third, the clipping means may take a number of forms other than that of the tongue-like clips 120 and 320, for example, as a flexible pin which extends parallel and adjacent to the body, and which may extend from the body of the marker holder to pierce clothing and may then be received in a hook (such structure being common in wearable identification badges and decorative/advertising buttons); as a rigid pin which extends from the body of the holder to pierce clothing, and which is then received within a separate base or mount (as with common tie tacks and the like); as one or more spring-loaded jaws which grasp items between the jaws, or between a jaw and the body of the marker holder; or in other forms. All of these various forms of clips are suitable, and the tongue-like clips 120 and 130 are merely preferred owing to their low expense and ease of manufacture, and their ability to mount to a variety of items without damaging the items.

Finally, it should be understood that the configuration of the marker holder may be varied in many ways from the configurations of the marker holders 100 and 300 shown in the drawings, and thus a marker holder is in no way limited to the appearance of the marker holders shown in FIGS. 1–3. As examples, the outer contours of the body of a marker holder need not conform to the shape of the pockets, nor do the pockets in the body need be vertically arrayed. Further, the clip need not extend from the top of the body, nor need it extend entirely from one side of the body to the other, nor need it have the configuration shown. The body may also contain components apart from the marker-holding pockets, e.g., it may be adapted to accommodate tees or other equipment as well.

To summarize, the invention is not intended to be limited to the preferred versions of the invention described above, but rather is intended to be limited only by the claims set out below. Thus, the invention encompasses all different versions that fall literally or equivalently within the scope of these claims.

What is claimed is:

1. A marker holder comprising:

a. a body having a first pocket defined therein, the first pocket being configured to snugly and removably receive a marker disc therein and being defined by a pair of opposing spaced flanges extending from the body, each flange extending from a pocket mouth to a pocket floor, whereby a slot extends between the flanges from the pocket mouth and pocket floor;

b. a clip extending downwardly and generally parallel and adjacent to the body, whereby a user's article of clothing may be inserted between the clip and the body to mount the body on a user.

2. The marker holder of claim 1 having a second pocket defined in the body adjacent the first pocket, and wherein the first and second pockets rest adjacently to each other in parallel spaced planes.

3. The marker holder of claim 2 wherein the first and second pockets have pocket mouths spaced from each other.

4. The marker holder of claim 2 wherein the first and second pockets are differently sized so as to snugly and removably receive differently sized marker discs.

5. The marker holder of claim 1 having a second pocket defined in the body adjacent the first pocket, and wherein the second pocket has an inner wall at least partially defined by the flanges of the first pocket, and an outer wall spaced therefrom.

6. The marker holder of claim 5 wherein the outer wall of the second pocket is also defined by a pair of opposing spaced flanges extending from the body, each flange extending from a pocket mouth to a pocket floor, whereby a slot extends between the flanges from the pocket mouth and pocket floor.

7. The marker holder of claim 1 wherein the first and second pockets are defined in parallel planes.

8. The marker holder of claim 7 wherein the first and second pockets have pocket mouths spaced from each other.

9. The marker holder of claim 8 wherein the mouth of one of the first and second pockets being located closer to the floor of the other of the first and second pockets than to the mouth of the other of the first and second pockets.

10. A marker holder comprising:

a. a body having:

(1) an inner wall, (2) an opposing outer wall defined by a pair of spaced flanges;

(3) opposing sidewalls extending between the inner and outer walls, and (4) a floor situated between the sidewalls, and extending between the inner and outer walls;

whereby a first pocket is defined between the inner and outer walls and the sidewalls, the first pocket having a first pocket mouth opposite and above the floor, and wherein the spaced flanges extend between the pocket mouth and floor;

b. a clip extending from the inner wall.

11. The marker holder of claim 10 wherein a second pocket is also defined in the body, the second pocket being defined between the outer wall of the first pocket and a second outer wall on the body.

12. The marker holder of claim 11, wherein the second outer wall is at least partially defined by a pair of spaced flanges on the body, the flanges extending inwardly towards each other.

13. The marker holder of claim 11 wherein the second pocket has a second pocket mouth situated below and spaced from the first pocket mouth, and wherein the first and second pockets are defined in parallel spaced planes.

14. The marker holder of claim 10 wherein a second pocket is also defined in the body, and wherein the first and second pockets are defined in parallel spaced planes.

15. The marker holder of claim 14 wherein at least one of the pockets has its outer wall define the inner wall of another one of the pockets.

16. A marker holder comprising:

a. a body having two or more pockets defined therein, each pocket being bounded by:

(1) an inner wall, (2) an opposing outer wall defined by spaced flanges extending across the entire depth of the pocket;

(3) opposing sidewalls extending between the inner and outer walls, and (4) a pocket mouth between the inner wall, outer wall, and sidewalls; and b. clipping means for mounting the body on a user.

17. The marker holder of claim 16 wherein the pocket mouths of the pockets are spaced at different heights along the body.

18. The marker holder of claim 16 wherein at least one of the pockets has its outer wall define the inner wall of another one of the pockets.

19. The marker holder of claim 16 wherein the pockets are configured to snugly and removably receive differently-sized marker discs.

* * * * *